United States Patent [19]

Covell

[11] Patent Number: 4,520,760

[45] Date of Patent: Jun. 4, 1985

[54] HEAT EXCHANGER OUTLET ARRANGEMENT

[75] Inventor: Russell B. Covell, Granby, Conn.

[73] Assignee: Combustion Engineering, Inc., Windsor, Conn.

[21] Appl. No.: 602,857

[22] Filed: Apr. 23, 1984

[51] Int. Cl.[3] ..... F22D 1/00; C10J 3/48

[52] U.S. Cl. ..... 122/7 R; 122/6 A; 48/77; 55/269

[58] Field of Search ..... 122/7 R, 6 A; 48/63, 48/77; 55/269

[56] References Cited

U.S. PATENT DOCUMENTS 4,309,196 1/1982 Vellhardt ..... 122/7 R
4,372,253 2/1983 Hibbel et al. ..... 122/7 R
4,377,132 3/1983 Koog et al. ..... 122/7 R
4,395,268 7/1983 Zabelka ..... 48/67

*Primary Examiner*—Henry C. Yuen
*Attorney, Agent, or Firm*—David L. Smith

[57] ABSTRACT

A fluid cooled heat exchanger (10) having a product gas outlet (26) near the bottom thereof for cooling product gas from a pressurized gasifier in which the product gas is caused to reverse direction before passing to the gas outlet (26). A uniform distribution of product gas flow radially outward during the flow reversal is achieved by providing a path of least resistance (62) to the product gas flow in the region most distant from the heat exchanger gas outlet (26) and a path of most resistance (62) in the region nearest the gas outlet and graduated openings (64) therebetween.

14 Claims, 4 Drawing Figures

HEAT EXCHANGER OUTLET ARRANGEMENT

BACKGROUND OF THE INVENTION

This invention relates to decreasing the dust loading of the product gas of a pressurized coal gasifier and in particular to decreasing the dust loading of the product gas before the product gas passes through a horizontal crossover duct near the bottom of the enclosure vessel to a convective cooling section.

In present pressurized gasification systems in which a carbonaceous fuel is gasified, the reaction gas together with combustion residues are cooled in a heat exchanger disposed directly beneath the reactor vessel. Heat transfer in the heat exchanger occurs predominantly by means of radiation. Typically, the product gas flows into the heat exchanger from the reactor vessel through an inlet at the top center of the heat exchanger. The product gas flows downward through the heat exchanger, reverses direction and flows upward to exit from the heat exchanger and surrounding vessel through an outlet near the top of the vessel. Typically, there is a body of water disposed in the lower region of the vessel surrounding the heat exchanger to receive and quench particulate matter discharged from the product gas stream as the gas stream reverses direction. The prior art heat exchangers typically have one or more gas outlets near the top of the enclosing vessel which provides a more uniform gas velocity from the region of downward product gas flow radially outward in the region where the product gas reverses direction to flow upward. A plurality of gas exits from the heat exchanger further enhances the uniform radial velocity of the product gas in the region where the flow direction reverses.

It is an object of this invention to provide a heat exchanger having a single gas outlet near the bottom of the heat exchanger that incorporates a product gas flow reversal of at least 180° while maintaining uniform radial gas velocity to enhance particulate matter separation.

SUMMARY OF THE INVENTION

In accordance with the present invention, a fluid cooled heat exchanger for cooling product gas having downward flow has a gas inlet at the top for receiving hot product gas with entrained solids and a gas outlet near the bottom for discharging cooled product gas. The fluid cooled water wall tapers inwardly near the bottom of the heat exchanger. A portion of the tapered water wall forms an inner gas tight passage for conducting the product gas beyond the taper. The remainder of the water wall forms an outer gas tight surface surrounding the inner gas tight surface and defining an annular passage that is in fluid communication with the heat exchanger gas outlet. The product gas is passed from the inner passage to the annular passage in a manner that causes the product gas with entrained solids to reverse direction before passing to the outlet. In accordance with the invention, a uniform distribution of product gas flow radially outward from the inner passage to the annular passage is achieved by providing a path of least resistance to the product gas flow in the region most distant from the heat exchanger gas outlet and a path of most resistance in the region nearest the heat exchanger gas outlet and a varying resistance therebetween. The product gas flow path resistance is varied between the inner product gas passage and the annular product gas passage by varying the flow area therebetween. The uniform distribution of product gas flow radially outward from the inner passage to the annular passage enhances particulate discharge from the product gas as the product gas with entrained solids is made to reverse direction before passing to the gas outlet.

DESCRIPTION OF THE PREFERRED EMBODIMFNT

Figure 1:
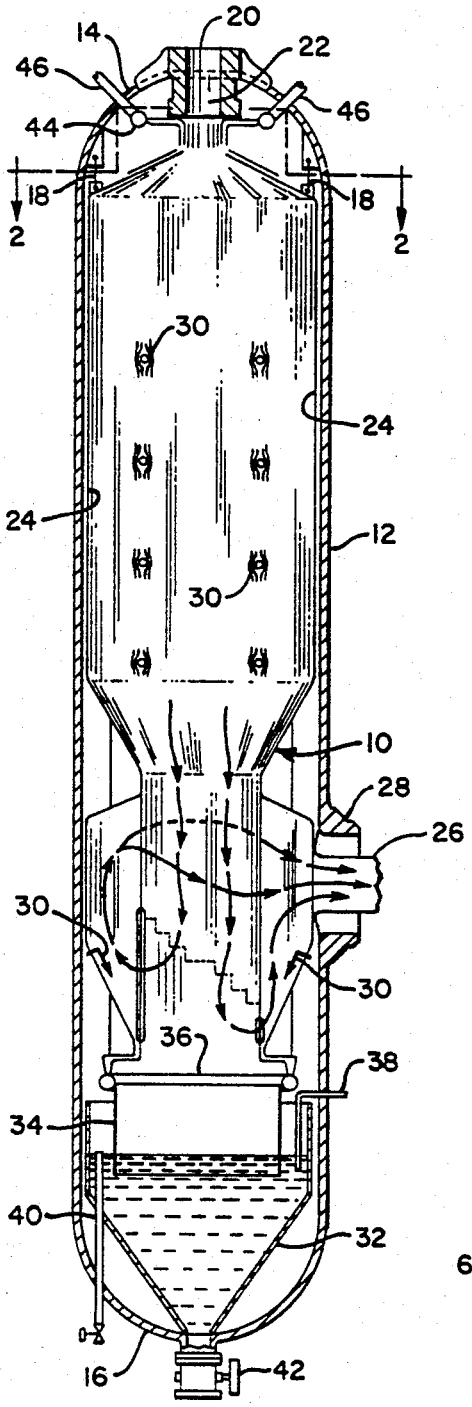
FIG. 1 is a side view, partially in section, of a fluid cooled heat exchanger in accordance with the present invention.
Figure 2:
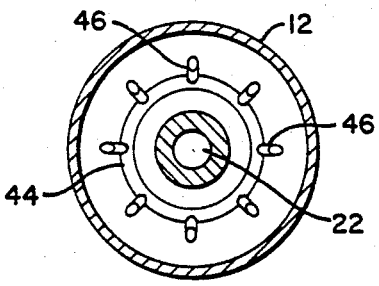
FIG. 2 is a top view taken along the lines 2—2 of FIG. 1 showing the annular fluid coolant outlet header.

Referring to the drawing, initially to FIG. 1, there is depicted therein a fluid cooled heat exchanger 10 for cooling the product gas of a pressurized gasifier in accordance with the present invention. Heat exchanger 10 is enclosed within enclosure vessel 12 which is cylindrical having hemispherical upper and lower ends 14 and 16, respectively. Heat exchanger 10 is supported within enclosure vessel 12 by supports 18 in the region of upper end 14. Hot product gas laden with particulate matter flows into enclosure vessel 12 through enclosure vessel gas inlet 20 and into fluid cooled heat exchanger 10 through heat exchanger gas inlet 22 coincident with enclosure vessel gas inlet 20. The hot product gas flows downwardly through the interior of heat exchanger 10 in heat exchange relation with fluid cooled water wall 24 beyond heat exchanger gas outlet 26 reversing direction and passing out through heat exchanger gas outlet 26 which is coincident with enclosure vessel gas outlet 28. A plurality of soot blowers 30 are provided to remove ash from the fluid cooled water wall 24.

The ash removed by soot blowers 30 as well as the particulate matter that is removed from the product gas stream by centrifugal force, aided by gravity, as the product gas stream reverses direction in the lower portion of heat exchanger 10 fall by gravity into water impounded hopper 32 in the lower portion of enclosure vessel 12. Water impounded hopper 32 when filled provides a body of water for receiving and quenching solids discharged from the product gas as the gas reverses direction. A water seal exists between water impounded hopper 32 and fluid cooled heat exchanger 10. Seal plate 34 extends from fluid coolant inlet header 36 to below the water level maintained in water impounded hopper 32. The water seal maintains the product gas pressure within seal plate 34 and water impounded hopper 32 at the same level as within heat exchanger 10 above water impounded hopper 32. The water seal permits thermal expansion of heat exchanger 10 downward from supports 18. The water seal is necessary as water impounded hopper 32 is usually supported by lower end 16 of enclosure vessel 12 whereas the heat exchanger is supported by upper end 14. The water level is maintained in water impounded hopper 32 by the addition of water through water fill line 38 or the deletion of water through overflow line 40. Valve 42 located near the bottom of water impounded hopper 32 provides a means of removing ash and other particulate matter from water impounded hopper 32 through enclosure vessel 12.

Fluid coolant, which in the preferred embodiment is water, enter fluid coolant inlet header 36 through supply lines (not shown). From inlet header 36 the fluid coolant passes upwardly through a plurality of tubes comprising fluid cooled water wall 24 in heat exchange relation with the product gas and is collected in toroidal fluid coolant outlet header 44. Heated coolant is removed from outlet header 44 through lines 46. Outlet header 44 is within upper end 14 external to heat exchanger 10 and not subjected to the product gas flow. Similarly, fluid coolant inlet header 36 is disposed beneath heat exchanger 10 in a region not subjected to the product gas flow. Removing the inlet and outlet headers from the product gas flow reduces the corrosion of the headers due to hydrogen sulfide which is typically present in such a product gas and the severity of which increases exponentially with increasing temperature.

Figure 3:
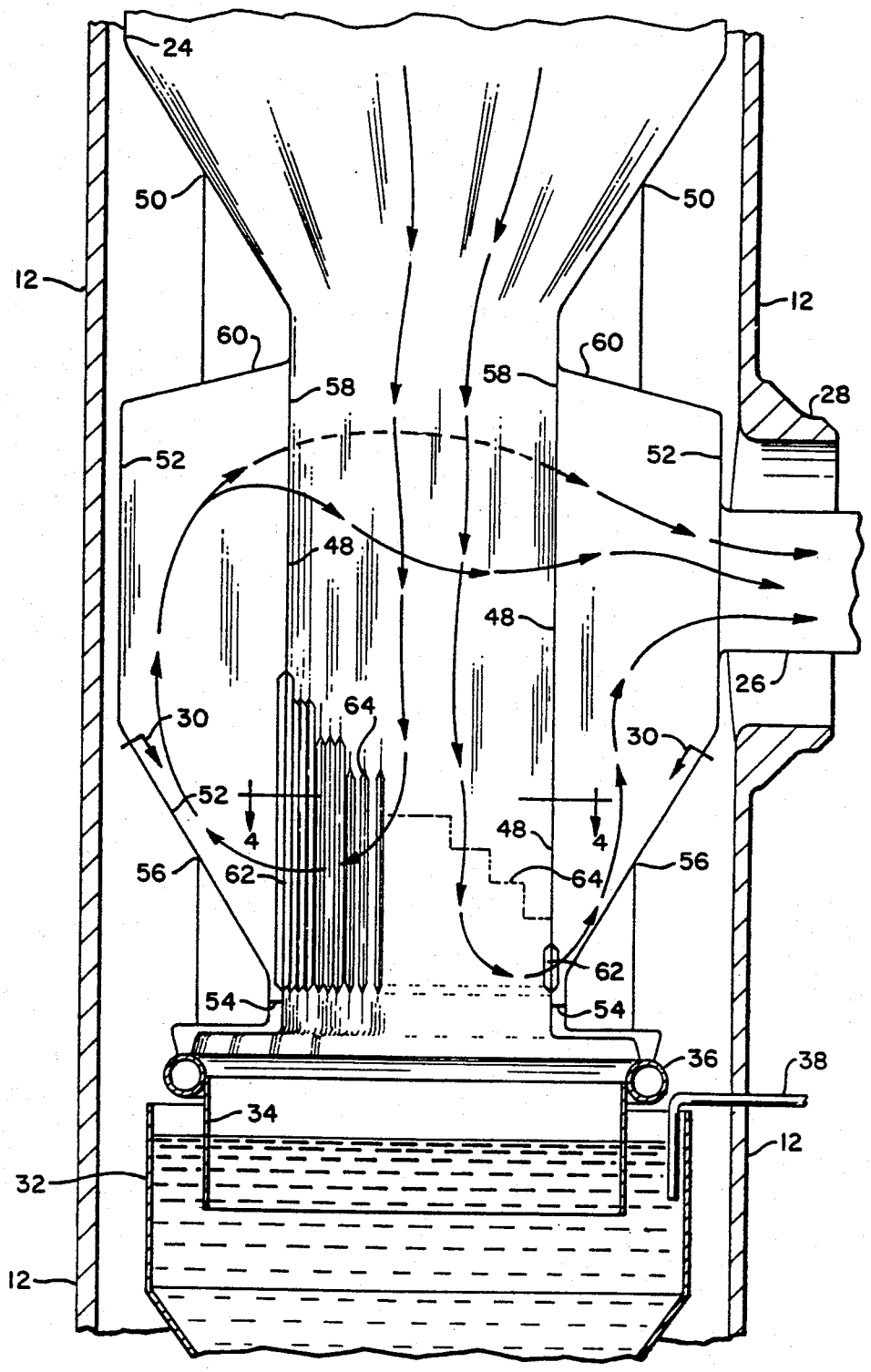
FIG. 3 is an enlarged side view, partially in section, of the lower portion of the heat exchanger in FIG. 1.

Heat exchanger 10 is substantially a cylindrical heat exchanger of a smaller diameter than the inside diameter of enclosure vessel 12. In the upper region of heat exchanger 10 fluid cooled water wall 24 tapers inward to form a gas tight seal with enclosure vessel gas inlet 20 requiring some of the tubes to overlay other tubes as the water wall approaches and terminates in fluid coolant outlet header 44. Water wall 24 in the lower region of heat exchanger 10 above gas outlet 26 tapers frustoconically inward as best seen in FIG. 3.

Heat exchanger 10 is fabricated of a welded tube and fin arrangement wherein tube spacing is maintained by a fin welded between adjacent tubes. As the tubes form the inward taper in the lower region of heat exchanger 10 the smaller surface of the taper does not require all of the tubes. Therefore a portion of the tubes forming water wall 24 continue from water wall 24 through the taper to form inner shell 48 which is a gas tight heat exchange surface enclosing a passage for conducting the product gas in the direction of product gas flow beyond the taper. The tubes overlayed in forming the taper at 50 form a part of outer shell 52 which is an outer gas tight heat exchange surface surrounding inner shell 48 and defining an annular passage between inner shell 48 and outer shell 52 that is in fluid communication with gas outlet 26. Outer shell 52 is cylindrical in the region of gas outlet 26 and tapers inwardly commencing beneath gas outlet 26 to intersect inner shell 48 at gas seal 54. All of the tubes forming outer shell 52 and inner shell 48 are in fluid communication with fluid coolant inlet header 36 and originate therein. A portion of the tubes forming outer shell 52 are overlayed at 56 in forming the taper in outer shell 52 beneath gas outlet 26. In some locations, it is necessary to bifurcate tubes to reduce tube spacing thereby keeping fin lengths between tubes short enough to maintain low metal temperature, thus minimizing hydrogen sulfide corrosion. In the preferred embodiment, fluid cooled water wall 24 has one third of its tubes overlayed at 50 with two thirds of its tubes forming the throat portion, all of which are bifurcated at locations 58 and 60 alternately to form inner shell 48 and outer shell 52.

Figure 4:
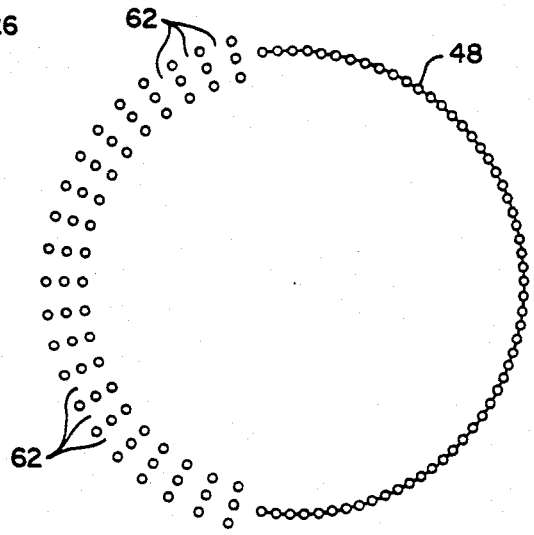
FIG. 4 is a cross section of the inner shell taken along the lines 4—4 of FIG. 3.

In accordance with the present invention, a plurality of screen openings are formed around the perimeter of inner shell 48 to permit the passage of product gas from within inner shell 48 to the annular space between inner shell 48 and outer shell 52 thence through gas outlet 26. The screen openings, as best viewed in FIGS. 3 and 4, are made by eliminating the fins between tubes and overlaying three tubes forming the lower portion of inner shell 48. Further in accordance with the invention, the flow area of the screen openings 62 is varied about the circumference of the inner shell 48 so as to selevitvely circumferentially distribute the product gas flow leaving the inner shell. The area of screen openings 62 are largest diametrically opposite gas outlet 26 and smallest adjacent gas outlet 26 with graduated openings therebetween as indicated by staircase finning line 64 such that the path of least resistance to the product gas flow from within inner shell 48 to the annular space between inner shell 48 and outer shell 52 is most distant from gas outlet 26 and the path of most resistance to the product gas flow from within inner shell 48 to the annular space between inner shell 48 and outer shell 52 is nearest gas outlet 26. Preferably, the flow area of the screen openings 62 is varied by varying the height of the openings 62. In this manner, the resistance encountered by the product gas between the throat of heat exchanger 10 and gas outlet 26 is uniform and independent of the precise path followed by the product gas stream.

The product gas stream passing through heat exchanger 10 flows downward through gas inlet 22 in heat exchange relation with water wall 24 through the throat and inner shell 48 reversing direction in the lower region of inner shell 48 with a uniform distribution of product gas flowing radially outward from inner shell 48 to the annular space between inner shell 48 and outer shell 52 thence through the annular space and exiting heat exchanger 10 through gas outlet 26. The uniform distribution of product gas flow results in enhanced particulate removal from the product gas stream.

Although the screen openings have been described in the preferred embodiment by overlaying tubes in groups of three and varying the area of the openings by varying the height of the screen openings along a staircase finning line, other means to accomplish the same function are contemplated within the scope of the invention.

I claim:

1. A fluid cooled heat exchanger for cooling product gas comprising:

a gas tight water wall, having a gas inlet at the top for receiving hot product gas with entrained solids and a gas outlet near the bottom for discharging cooled product gas, for radiant heat exchange from the product gas to fluid passing through the water wall;

an inward taper in the water wall near the bottom of the water wall;

a first portion of the tapered water wall forming an inner gas tight heat exchange surface enclosing a passage for conducting the product gas beyond the inward taper;

a second portion of the water wall forming an outer gas tight heat exchange surface surrounding the inner gas tight heat exchange surface and defining an annular passage therebetween, the annular passage in fluid communication with the gas outlet; and a plurality of openings in the inner gas tight heat exchange surface for passing the product gas from within the inner gas tight heat exchange surface to the annular space between the inner and outer heat exchange surfaces, said openings over a range of sizes with the largest opening most distant from the gas outlet and the smallest opening nearest the gas outlet and with openings of graduated area therebetween whereby the path of least resistance to the product gas flow from within the inner gas tight heat exchanger surface to the annular space between the inner and outer heat exchange surfaces is most distant from the gas outlet and the path of most resistance is nearest the gas outlet.

2. A fluid cooled heat exchanger for cooling product gas as recited in claim 1 further comprising an inlet header to provide fluid to the water wall wherein the inlet header is removed from the product gas flow stream.

3. A fluid cooled heat exchanger for cooling product gas as recited in claim 1 wherein the product gas flow passes beyond the gas outlet and reverses direction before passing to the gas outlet.

4. A fluid cooled heat exchanger as recited in claim 1 further comprising a plurality of soot blowers spaced along the water wall for cleaning the heat transfer surfaces thereof.

5. A fluid cooled heat exchanger as recited in claim 1 wherein the fluid is water.

6. A fluid cooled heat exchanger for cooling product gas as recited in claim 1 wherein the gas tight water wall is substantially cylindrical.

7. A fluid cooled heat exchanger as recited in claim 6 wherein the inner gas tight heat exchange surface beyond the taper in the direction of product gas flow is substantially cylindrical and coaxial with the water wall.

8. A fluid cooled heat exchanger for cooling product gas comprising:

an outer shell having an inlet for receiving hot product gas with entrained solids at the top of the shell and an outlet for discharging cooled product gas near the bottom of the shell;

a gas tight water wall within the outer shell having a gas inlet for receiving hot product gas with entrained solids and a gas outlet for discharging cooled product gas coincident with the inlet and outlet of the outer shell, the water wall extending substantially the full length of the shell for radiant heat exchange from the product gas to fluid passing through the water wall;

an inward taper in the water wall near the bottom of the water wall;

a first portion of the tapered water wall forming an inner gas tight heat exchange surface enclosing a passage for conducting the product gas beyond the inward taper;

a second portion of the water wall forming an outer gas tight heat exchange surface surrounding the inner gas tight heat exchange surface and defining an annular passage therebetween, the annular passage in fluid communication with the gas outlet;

a plurality of openings in the inner gas tight heat exchange surface for passing the product gas from within the inner gas tight heat exchange surface to the annular space between the inner and outer heat exchange surfaces, said openings over a range of sizes with the largest opening most distant from the gas outlet and the smallest opening nearest the gas outlet and with graduated openings therebetween whereby the path of least resistance to the product gas flow from within the inner gas tight heat exchanger surface to the annular space between the inner and outer heat exchange surfaces is most distant from the gas outlet and the path of most resistance is nearest the gas outlet; and means at the bottom of the shell for providing a body of water and for receiving and quenching the entrained solids discharged from the product gas as it turns in passing from within the inner gas tight heat exchanger surface to the annular space between the inner and outer heat exchange surfaces.

9. A fluid cooled heat exchanger for cooling product gas as recited in claim 8 further comprising an inlet header to provide fluid to the water wall wherein the inlet header is removed from the product gas flow stream.

10. A fluid cooled heat exchanger for cooling product gas as recited in claim 8 wherein the product gas flow passes beyond the gas outlet and reverses direction before passing to the gas outlet.

11. A fluid cooled heat exchanger as recited in claim 8 further comprising a plurality of soot blowers spaced along the water wall for cleaning the heat transfer surfaces thereof.

12. A fluid cooled heat exchanger as recited in claim 8 wherein the fluid is water.

13. A fluid cooled heat exchanger for cooling product gas as recited in claim 8 wherein the gas tight water wall is substantially cylindrical.

14. A fluid cooled heat exchanger as recited in claim 13 wherein the inner gas tight heat exchange surface is substantially cylindrical and coaxial with the water wall.

* * * * *